US008407853B1

(12) United States Patent
Baxt

(10) Patent No.: US 8,407,853 B1
(45) Date of Patent: Apr. 2, 2013

(54) HIGH PLACE VACUUM CLEANER ATTACHMENT

(76) Inventor: John Baxt, Tomball, TX (US)

( * ) Notice: Subject to any disclaimer, the term of this patent is extended or adjusted under 35 U.S.C. 154(b) by 1458 days.

(21) Appl. No.: 11/581,167

(22) Filed: Oct. 12, 2006

(51) Int. Cl.
*A47L 9/02* (2006.01)

(52) U.S. Cl. ..... 15/414; 15/394

(58) Field of Classification Search ..... 15/414, 15/394, 395, 398
See application file for complete search history.

(56) References Cited

U.S. PATENT DOCUMENTS

| | | | | |
|---|---|---|---|---|
| 1,012,195 | A | 12/1911 | English | |
| 1,658,311 | A * | 2/1928 | Tonso | 15/415.1 |
| 1,838,481 | A * | 12/1931 | Gudka | 15/367 |
| 2,203,088 | A * | 6/1940 | Hansson | 285/7 |
| 2,528,599 | A * | 11/1950 | Loether | 401/290 |
| 2,581,047 | A * | 1/1952 | Salmond et al. | 285/181 |
| 3,565,464 | A | 2/1971 | Wolf | |
| 4,336,628 | A | 6/1982 | Bradshaw et al. | |
| 4,397,060 | A | 8/1983 | Jinkins et al. | |
| 4,473,923 | A * | 10/1984 | Neroni et al. | 15/377 |
| 4,866,565 | A * | 9/1989 | Wray, Jr. | 361/215 |
| 4,969,837 | A * | 11/1990 | Genoa et al. | 439/191 |
| 5,064,226 | A * | 11/1991 | Klas | 285/184 |
| 5,161,336 | A * | 11/1992 | Ritt et al. | 451/87 |
| 5,410,776 | A * | 5/1995 | Schneider | 15/398 |
| 5,488,754 | A * | 2/1996 | Shadley | 15/394 |
| 5,720,501 | A * | 2/1998 | Ortloff et al. | 285/93 |
| 5,927,758 | A | 7/1999 | Carlsson | |
| 6,098,241 | A * | 8/2000 | Wood | 15/323 |
| 6,209,925 | B1 * | 4/2001 | Edin | 285/7 |
| 6,237,962 | B1 * | 5/2001 | Lim | 285/7 |
| 6,257,505 | B1 * | 7/2001 | Wang | 239/526 |
| 6,308,366 | B1 * | 10/2001 | Hays | 15/115 |
| 6,581,974 | B1 * | 6/2003 | Ragner et al. | 285/7 |
| 6,904,640 | B2 * | 6/2005 | Jin et al. | 15/410 |
| 6,991,262 | B1 * | 1/2006 | Ragner | 285/7 |
| 7,036,183 | B2 * | 5/2006 | Gammack et al. | 15/335 |
| D575,918 | S * | 8/2008 | Rosenzweig et al. | D32/40 |
| 2003/0167592 | A1 * | 9/2003 | Egnatovich, Jr. | 15/394 |
| 2006/0181079 | A1 * | 8/2006 | Gilpatrick et al. | 285/308 |
| 2008/0178419 | A1 * | 7/2008 | Courtney et al. | 15/363 |

FOREIGN PATENT DOCUMENTS

| | | |
|---|---|---|
| EP | 1.543.757 | 6/2005 |
| GB | 1.286.985 | 8/1972 |
| GB | 2.416.680 | 2/2006 |

* cited by examiner

*Primary Examiner* — Robert Scruggs
(74) *Attorney, Agent, or Firm* — Michael I. Kroll

(57) ABSTRACT

The present invention (High Place Vacuum Cleaner) relates generally to vacuum cleaners and, more specifically to a simple attachment for a vacuum cleaner so that the operator may reach high places with ease. The attachment is a wand with an elongated bent handle and a tool, which has a rotatable connection to the handle. The wand may have an adaptor so that the handle can be connected to the hose of a wet/dry vacuum cleaner. The wand may have an adaptor so that the handle can be connected to the hose of a wet/dry vacuum cleaner for dirty outside work. The wand with or without extender(s) may be utilized to clean ceiling fan housing and blades, high windows, light fixtures, high ceilings, air conditioner registers, as well as outside windows, eaves of a home, underside of elevated decks, etc. The present invention is also operable in both push or pull directions of motion. The tool has a brush to dislodge dust and other material while drawing suction from both sides of the brush while it is being utilized in a cleaning action. Additionally the present invention is adaptable and lockable to existing vacuum lines and allows for an extended reach for the user.

9 Claims, 11 Drawing Sheets

HIGH PLACE VACUUM CLEANER ATTACHMENT

BACKGROUND OF THE INVENTION

1. Field of the Invention

Figure 1:
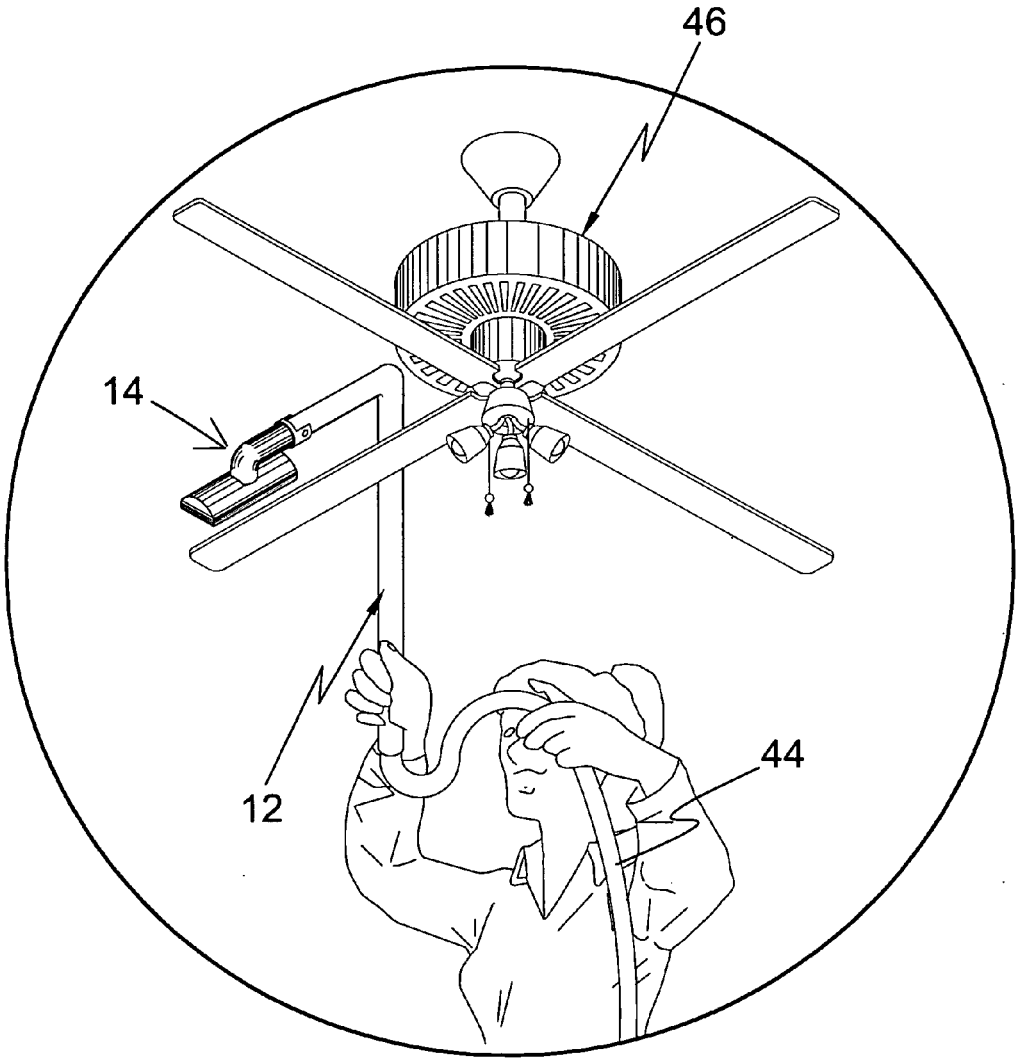

The present invention (High Place Vacuum Cleaner) relates generally to vacuum cleaners and, more specifically to a simple attachment for a vacuum cleaner so that the operator may reach high places with ease. The attachment is a wand with an elongated bent handle and a tool, which has a rotatable connection to the handle. The wand may have an adaptor so that the handle can be connected to the hose of a wet/dry vacuum cleaner. The wand may have an adaptor so that the handle can be connected to the hose of a wet/dry vacuum cleaner for dirty outside work. The wand with or without extender(s) may be utilized to clean ceiling fan housing and blades, high windows, light fixtures, high ceilings, air conditioner registers, as well as outside windows, eaves of a home, underside of elevated decks, etc. The present invention is also operable in both push or pull directions of motion. The tool has a brush to dislodge dust and other material while drawing suction from both sides of the brush while it is being utilized in a cleaning action. Additionally the present invention is adaptable and lockable to existing vacuum lines and allows for an extended reach for the user.

2. Description of the Prior Art

There are other cleaning attachment devices designed for the same purpose. Typical of these is U.S. Pat. No. 1,012,195 issued to English on Dec. 19, 1911.

Another patent was issued to Gudka on Dec. 29, 1931 as U.S. Pat. No. 1,838,481. Yet another U.S. Pat. No. 2,203,088 was issued to Hansson on Jun. 4, 1940 and still yet another was issued on Feb. 23, 1971 to Wolf as U.S. Pat. No. 3,565,464

Another patent was issued to Bradshaw et al. on Jun. 29, 1982 as U.S. Pat. No. 4,336,628. Yet another U.S. Pat. No. 4,397,060 was issued to Jinkins et al. on Aug. 9, 1983. Another was issued to Schneider on May 2, 1995 as U.S. Pat. No. 5,410,776 and still yet another was issued on Jul. 27, 1999 to Carlsson as U.S. Pat. No. 5,927,758.

Another patent was issued to Ragner et al. on Jun. 24, 2003 as U.S. Pat. No. 6,581,974. Internationally, a Great Britain Patent No. GB1,286,985 was issued to Meghji on Aug. 31, 1972. Another Great Britain Patent No. GB2,416,680 was issued to Fischer et al. on Feb. 8, 2006. Additionally, European Patent Application No. EP1543757 to Park was published on Jun. 22, 2005.

U.S. Pat. No. 1,012,195

Inventor: Frederick A. English

Issued: Dec. 19, 1911

This invention relates to an improvement in the class of pneumatic cleaners in which a motor operates a fan or blower to suck through a tube dust and other foreign matter from carpets, floors, furniture and other articles or furnishings in rooms and hallways of buildings; and it relates, more particularly stated, to the construction of the suction-tube to render it adjustable for adapting its head-carrying end to be readily applied by the person handling the tube to out-of-the-way places, such as the tops of moldings; the floors beneath beds and couches, and the like, and thus render such places conveniently accessible.

U.S. Pat. No. 1,838,481

Inventor: Elmer E. Gudka

Issued: Aug. 26, 1929

The present invention, relating, as indicated, to cleaning and polishing apparatus, is more particularly directed to the provision of a device for cleaning and polishing floors, such device consisting of a chambered head having an operably connected tube adapted for association with a vacuum system and a downwardly opening mouth carrying brush and mop means for use in contact with the floor, such brush and mop means functioning to collect dust and polish the floor surface and the air coursing towards said chamber acting to entrain at least a part of the dust and convey it into a collecting receptacle.

U.S. Pat. No. 2,203,088

Inventor: Erik Oskar Helge Hansson

Issued: Jun. 4, 1940

The present invention is a suction nozzle including a first member having an air passage adapted to be connected to a sou7rce of suction, a second member having an air passage communicating with a nozzle opening, each of said members formed with a hemispherical end having a circular edge in a plane oblique with respect to the respective air passage, means to secure together said sections in coupled relation comprising an arcuate resilient band overlying said hemispherical ends and removably engaging the hemispheres at the opposite ends of the diameter normal to the plane of said edges, and means to retain said band in engagement with said hemispheres to resiliently hold said hemispherical ends together in substantial air-tight relation while permitting them to be pivoted relative to each other through a relatively wide angle, the resiliency of said band retaining the edges in abutting contact.

U.S. Pat. No. 3,565,464

Inventor: Lee A. Wolf

Issued: Feb. 23, 1971

A swivel type coupling assembly for use with an operating member or members, such as the operating wand of a vacuum cleaner and/or the flexible vacuum cleaner hose of the vacuum cleaner, for movably coupling the operating member or members to the source of suction. The coupling assembly comprises first and second coupling members disposed in coacting generally axially aligned relatively rotatively rotatable relation, and with a resilient ring type sealing member coacting between the coupling members for sealing the juncture between the members against ingress of ambient air, thus maintaining the suction efficiency of the cleaner while permitting relative rotary movement between the coupling members, thereby permitting swiveling movement of the operating member or members with respect to the suction source.

U.S. Pat. No. 4,336,628

Inventor: David A. Bradshaw, et al.

Issued: Jun. 29, 1982

The invention described provides a nozzle that includes a pivoted wand to permit relative movement in a vertical plane between the wand and nozzle during manipulation by the operator. The center for the pivot for the wand is located at floor level. This permits friction generated forces that are imparted to the nozzle to be imposed so as to prevent unbalanced moments being generated tending to tip the nozzle during its movement over a floor or carpeting.

U.S. Pat. No. 4,397,060

Inventor: Danny R. Jinkins, et al.

Issued: Aug. 9, 1983

A vacuum cleaner tool is removably mounted on the elongated wand of a conventional vacuum cleaner. The tool includes a head or main housing having a forwardly-disposed brush enclosure portion with a lower planar opening formed therein. A brush is rotatably journaled in the brush enclosure portion of the housing and protrudes below the opening therein. An air turbine is rotatably journaled in the housing and is drivingly connected to the brush. The axis of the housing is coincident with the axis of the wand, and both are arranged at 45 degrees with respect to the planar opening for the brush. In one position, the planar opening is in a horizontal plane. The mounting means between the housing and the wand includes a swivel member. This swivel member enables the housing to be rotated 180 degrees with respect to the wand. When so rotated, the planar opening for the brush is in a vertical plane. As a result, the tool facilitates the cleaning of horizontal and vertical surfaces (such as stair steps) without requiring the operator to change the orientation of the wand with respect to the working surfaces.

U.S. Pat. No. 5,410,776

Inventor: Norman J. Schneider

Issued: May 2, 1995

An elongated body, has internally formed a plenum chamber opening to one face of the body. A pair of side brushes mounted on the face projected outwardly thereof and being spaced laterally from each other and extending over the major length of the body. A pair of longitudinally opposed end brushes spanned transversely across the body face from one side brush to the other project outwardly of the one face in the direction of the side brushes and form with the side brushes a vacuum chamber. The tips of the side brushes are formed of bristles of a length in excess of the length of bristles formed by the side brushes, and are engageable with laterally opposed longitudinally extending opposite side edges of planar ceiling fan blades. The side brushes are spaced from each other a distance generally equal to the lateral width of the ceiling fan blades. Locking plates fixed to the body project outwardly from opposite ends of the body longitudinally outside of the end brushes and in contact therewith such that the ceiling fan brush is effectively locked by the locking plates to the opposite side edges of the fan blade to facilitate dust removal from the surface of the fan blade enveloped by the ray of side brushes and end brushes while mechanically guiding the ceiling fan brush during travel longitudinally over the surface of the ceiling fan blade from one end to another.

U.S. Pat. No. 5,927,758

Inventor: Arne Carlsson

Issued: Jul. 27, 1999

A vacuum cleaner tube shaft having a first tube shaped part and a second tube shaped part. The first part is slidably arranged in the second part and is adapted to be releasably locked to the second part in a desired position. The second part includes two sections which are connected to each other via a pivot. When the first part is inserted in the two sections, the two sections are aligned with respect to each other. When the first part is inserted into only one section of the second part, the sections can be positioned in a desired angular position with respect to each other.

U.S. Pat. No. 6,581,974

Inventor: Gary Dean Ragner, et al.

Issued: Jun. 24, 2003

The disclosed swivel adaptor is assembled into two sections: tool member, and adaptor member. These two sections are pivotally attached, and can pivot with respect to each other around pivot axis. Pivot axis is angled off-axis with respect to the longitudinal axises of the adaptor sections to allow various angled positions for adaptor. The angle between the tool port end and adaptor port end being adjustable between an in-line position where members and form a relatively straight adaptor, and a plurality of angled positions where the longitudinal axises of ports and are not parallel. Adaptor has a pivotal air passageway connecting end to end. In the straight position, tabs snap into place to provide a holding force to keep the two sections from pivoting during use. By applying a sufficient twisting force on the two sections, tab slips loose and the two sections can rotate about axis. Tool member is designed to fit into standard vacuum cleaner nozzles. Adaptor member is designed to fit onto both vacuum wand hoses and vacuum wand ports.

Great Britain Patent Number GB 1286985

Inventor: Abdul Malek Rajabali Meghji

Issued: Aug. 31, 1972

Figure 4:
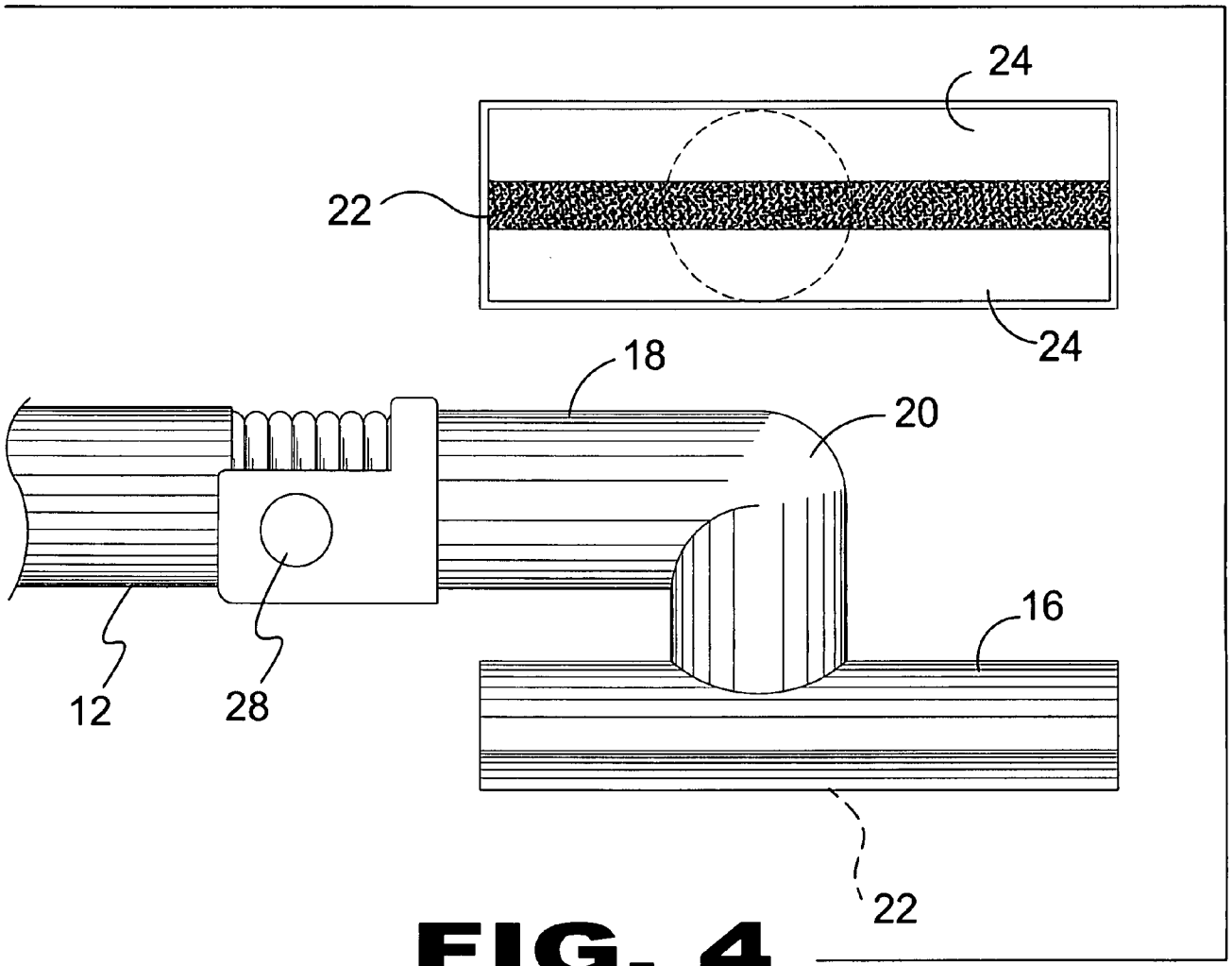
Figure 7:
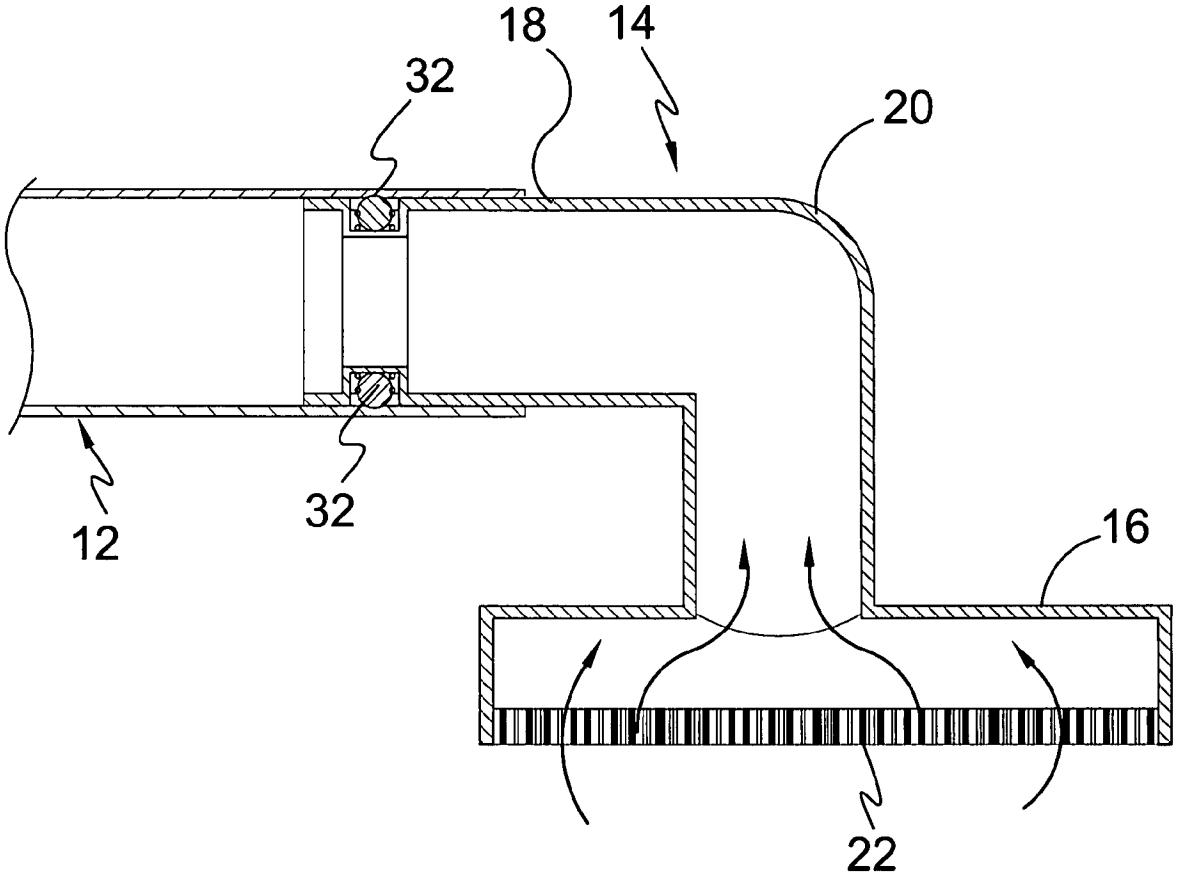

Apparatus for cleaning carpets, upholstery, walls, ceilings, and floors comprises a cleaning head 97, FIG. 7, movable over the surface to be cleaned and formed with a suction inlet chamber 13 connected by a flexible hose to a suction unit A, FIG. 1 in which used cleaning liquid is collected, the cleaning head also being formed with a chamber 19 from which steam and/or cleaning liquid is discharged on to the surface to be cleaned from nozzles 108 connected by a hose 17 to a self contained steam generating unit B FIG. 4 (not shown). The suction unit A comprises upper and lower sections 28, 29 detachable from one another, and a suction pump 4 in the section 29 driven by a motor 3 and drawing used cleaning liquid into a chamber 10 in the section 28 via an inlet connection 48 immediately beneath an inclined partition 6 separating the chamber 10 from a chamber 9 to which suction is applied by the pump 4 via a pipe 5. Suction is applied to the chamber 10 via a tube 40 inter-connecting the chambers 9, 10 and containing a ball valve 45 which closes when the liquid collected in the chamber 10 reaches a pre-determined level.

Great Britain Patent Number GB2416680

Inventor: Richard J. Fischer, et al.

Issued: Feb. 8, 2006

An upright vacuum cleaner (10) is equipped with a hose and telescopic handle and wand assembly (24) that are both electrified. In addition, the vacuum cleaner (10) includes a powered cleaning tool attachment (50). The powered cleaning tool attachment (50) may include a headlight (54), a rotary agitator (52) and rotary agitator drive motor (56) and/or a booster fan and booster fan drive motor (58). Each of these accessories of the tool attachment is powered through the hose and telescopic handle and wand assembly (24). Preferably the wand assembly consists of a first (26) and second parts (28).

European Patent Application EP1543757

Inventor: Joung-Soo Park

Published: Jun. 22, 2005

An extension pipe with a joint for a vacuum cleaner which forms a sealed channel between a cleaner body and a suction brush and includes a part bendable by a user's selection. The extension pipe includes a first extension pipe (110), a second extension pipe (120) pivotably connected to the first extension pipe, at least one separation preventing cap (130) penetrating through the first and the second pipes (110,120) from the outside of the first extension pipe (110), and a locking unit (140) hingedly connected to the first extension pipe (110). The locking unit (140) hooks the second extension pipe (120) and selectively locks the pivotal movements of the first and the second extension pipes (110,120). Further, the locking unit (140) releases the locking of the second extension pipe (120) so that the first and the second extension pipes (110, 120) can be bent.

While these cleaning attachment devices may be suitable for the purposes for which they were designed, they would not be as suitable for the purposes of the present invention, as hereinafter described.

SUMMARY OF THE PRESENT INVENTION

A primary object of the present invention is to provide a vacuum attachment that allows for the user to effectively reach and clean hard to reach horizontal and vertical surfaces without changing the orientation of the wand in respect to a work surface.

Another object of the present invention is to provide a vacuum attachment having a brush that is rotateably adjustable to a plurality of angles and orientations to reach hard to clean areas more efficiently while having a form that draws suction from both sides of the brush Yet another object of the present invention is to provide a vacuum attachment having a bent handle with a 90° bend to further maneuver the cleaning head into a desired position.

Still yet another object of the present invention is to provide a vacuum attachment that allows for attachment and locking to an existing vacuum setup and appropriate adapter for wet/dry vacuum and outdoor use.

Another object of the present invention is to provide a vacuum attachment that has a brush to more effectively break up and remove matter.

Additional objects of the present invention will appear as the description proceeds.

The present invention overcomes the shortcomings of the prior art by providing a vacuum attachment having a handle and rotatable tool that locks into position via a plurality of spring loaded balls and cooperating holes, where the balls are disengaged with a release mechanism, the tool includes a brush positioned such to draw suction from both sides of the brush for the removal of hard to reach dirt that may be otherwise inaccessible by conventional means. Additionally the present invention may be attached and locked onto an existing vacuum hoses.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
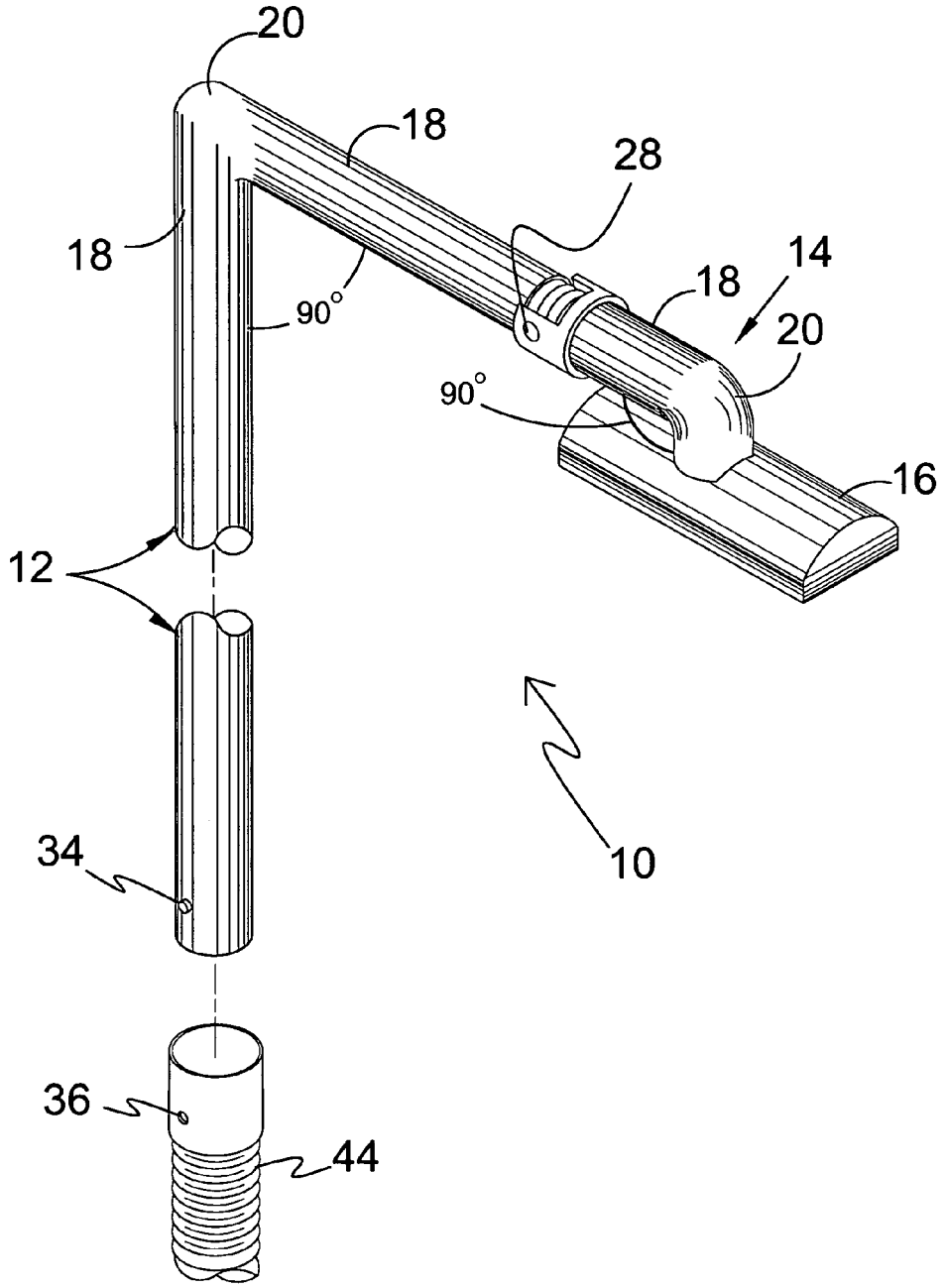
Figure 3:
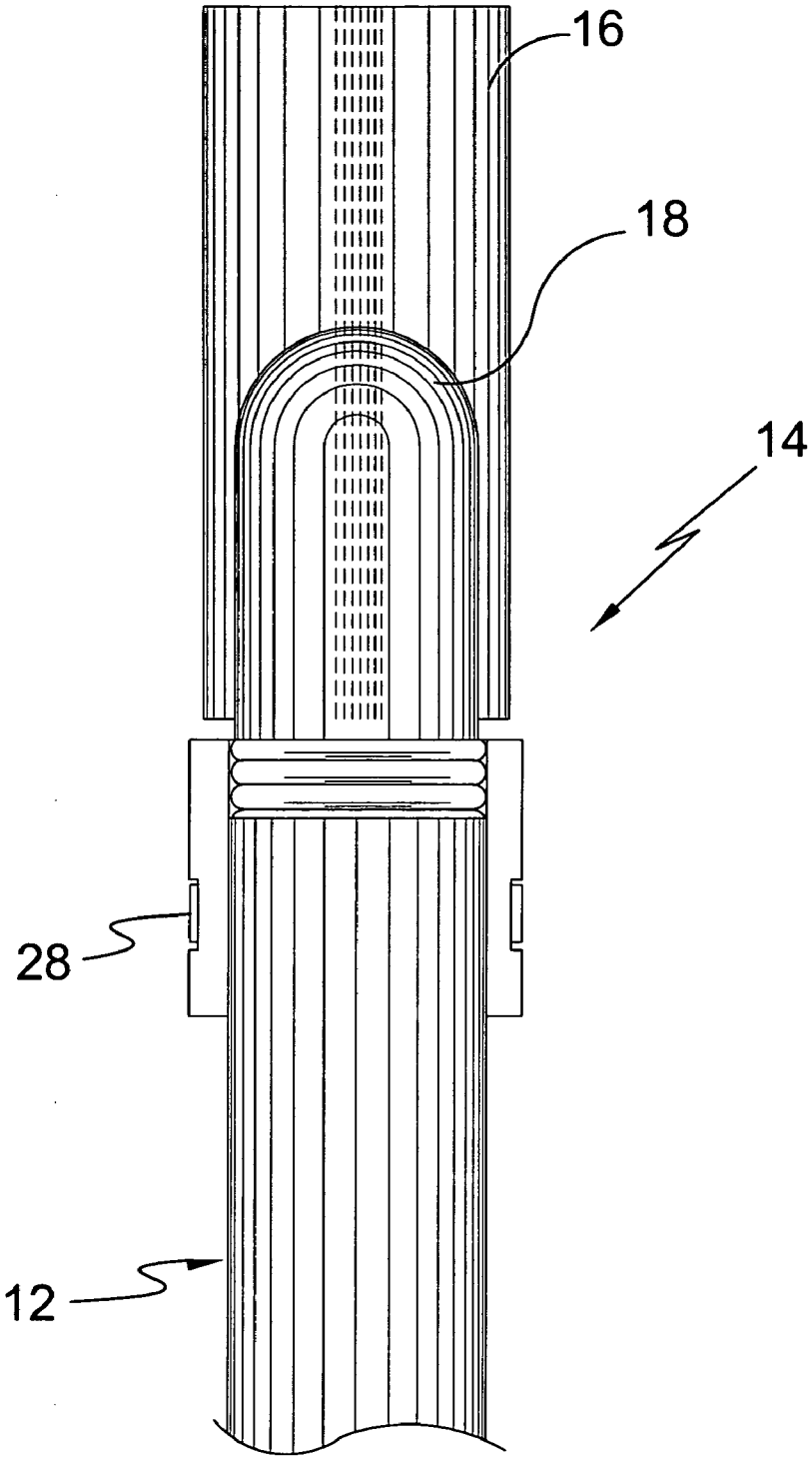
Figure 5:
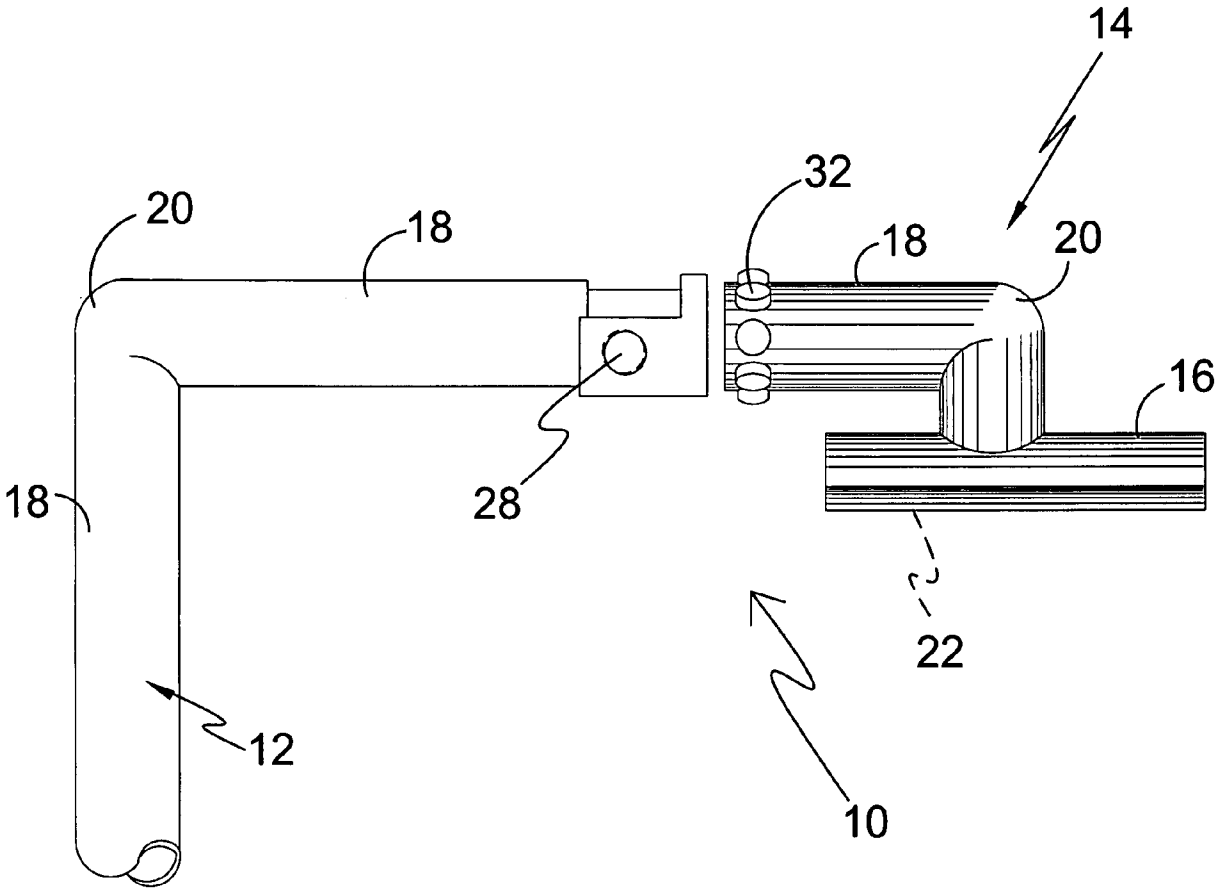
Figure 6:
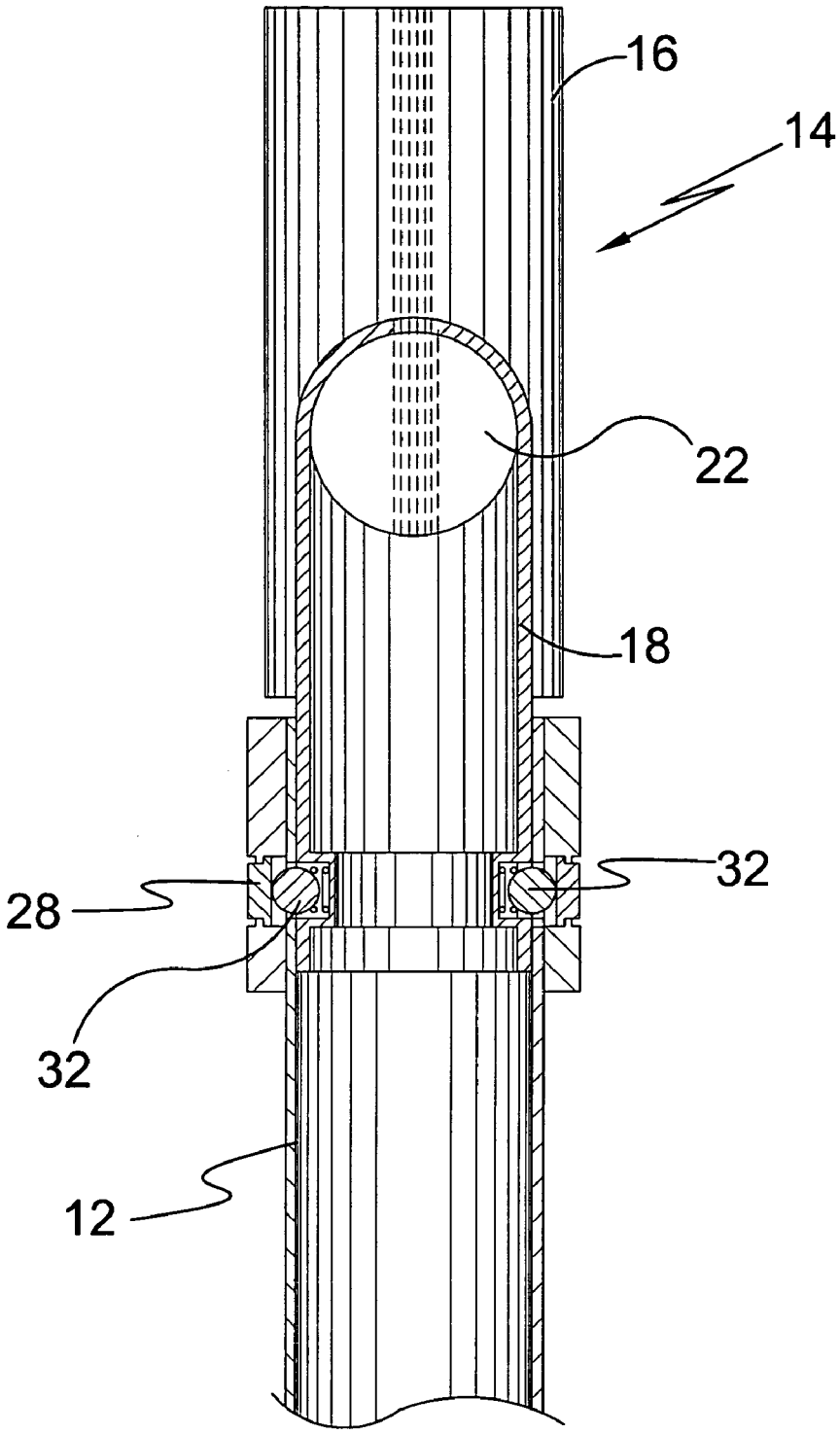
Figure 6A:
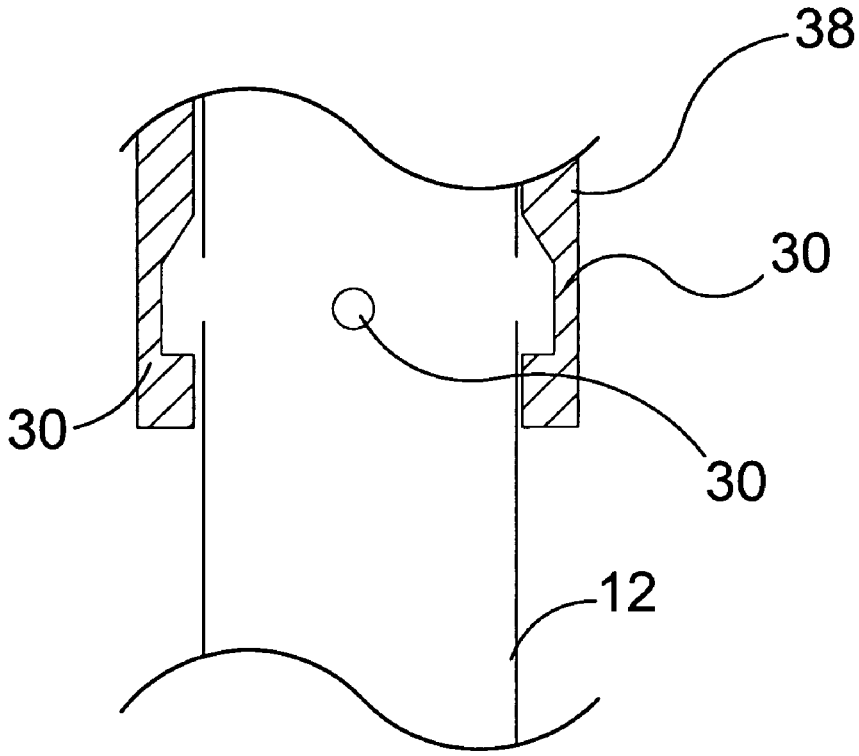
Figure 8:
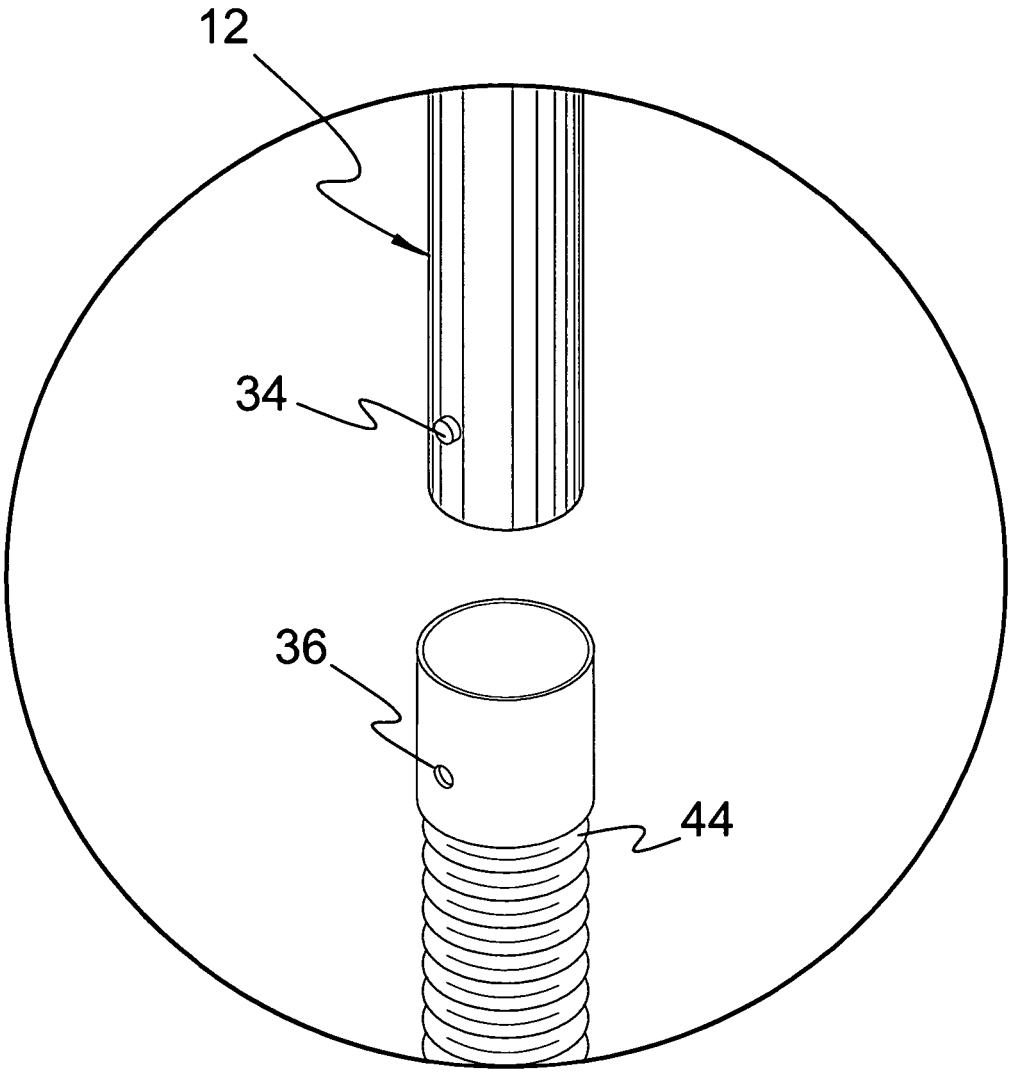
Figure 8A:
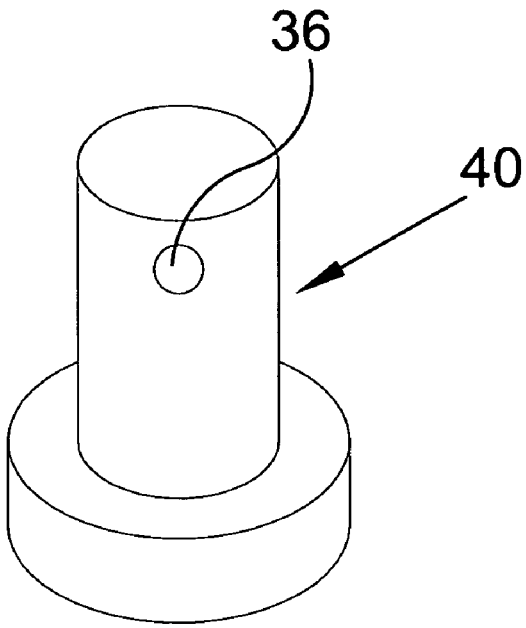
Figure 8B:
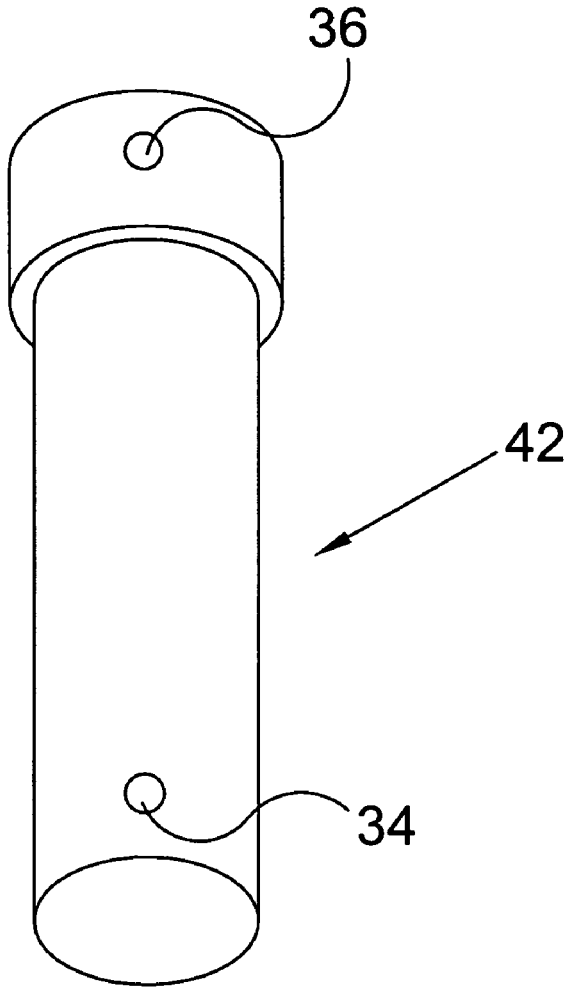

In order that the invention may be more fully understood, it will now be described, by way of example, with reference to the accompanying drawing in which:

FIG. 1 is an illustrative view of the present invention in use.
FIG. 2 is a perspective view of the present invention.
FIG. 3 is a top view of the present invention.
FIG. 4 is a side view of the present invention.
FIG. 5 is a side view of the present invention.
FIG. 6 is a top sectional view of the present invention.
FIG. 6A is a top sectional view of another embodiment of the present invention.
FIG. 7 is a side sectional view of the present invention.
FIG. 8 is a detailed view of the attachment portion of the present invention.
FIG. 8A is a perspective view of an adaptor of the present invention.
FIG. 8B is a perspective view of an extender of the present invention.

LIST OF REFERENCE NUMERALS

With regard to reference numerals used, the following numbering is used throughout the drawings.

10 Present Invention
12 Handle
14 Tool
16 Base
18 Tubular Extension
20 Tubular Bend
22 Brush
24 Suction Opening
26 Connector
28 Release Button
30 Holes
32 Spring-Loaded Balls
34 Locking Button
36 Locking Aperture
38 Release Slide
40 Wet/Dry Adapter
42 Tubular Extender
44 Vacuum Cleaner Hose
46 Ceiling Fan

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention 10 is a wand for attachment to a vacuum cleaner hose 44. The wand combines an elongated bent handle 12 and a tool 14 rotateably mounted thereon. The tool 14 enables a user to clean surfaces, which are normally out of their reach without requiring the user to get on a ladder. The tool 14 has a base 16 where the base 16 has upper and lower ends. The upper end of the base 16 has a tubular extension 18 secured thereon. The tubular extension 18 is attached to the base 16 by a tubular bend 20. There may be a short tubular extension 18 between the base 16 and the tubular bend 20. The tubular extension 18 is attached to the base 16 so that it is offset from the center of the base 16 as seen in FIGS. 4 and 7. This provides the tool 14 with a greater reach. As seen in FIGS. 4 and 7, the lower end of the base 16 has a brush 22 mounted therein for cleaning the surface on which it is disposed. The lower end of the base 16 is provided with suction openings 24 on either side of the brush. See FIG. 4 where the suction openings 24 are shown. The location of the section openings 24 on either side of the brush 22 enables the user to puck up debris in both forward and backward motions along a plane that is transverse to the central longitudinal axis of the brush 22. The tool 14 and the handle 12 each have mating connectors for joining the two components. The connector on the tool 14 is a plurality of spring-loaded balls 32 as seen in FIG. 5. The connector on the handle 12 is a plurality of holes 30 for receiving the spring-loaded balls 32 as seen in FIG. 6. When the spring-loaded balls 28 are received into the holes 30 in the handle 12 the two components are joined. The handle 12 may be provided with two release buttons 28, one for each hole 30 (see FIGS. 2-5) or a release slide 38 (see FIG. 6A) to disengage the spring-loaded balls 32 from the holes 30 thereby allowing the user to rotate the tool 14 with respect to the handle 12 or to remove the tool 14 from the handle 12. The slide 38 is employed when there are more than two holes 30 in the handle 12. Preferably the handle 12 has at least two holes 30 but it may employ more than two holes 30. It is desired to allow the tool 14 to be locked into four positions relative to the handle 12. To make this possible with two holes 30 in the handle 12 the plurality of balls 32 on the tool 14 must be at least four spring-loaded balls 32. The tool 14 may employ more than four spring-loaded balls 32. In the case where the handle 12 has two holes 30 and the tool 14 has four balls 32; the balls 32 will be equally spaced from each other with a spacing of 90 degrees between adjacent balls 32. This spacing in combination with the two holes 30 in the handle 12 will allow the tool 14 to be locked into four distinct positions where each position is spaced 90 degrees from adjacent positions.

The first position is where the lower end of the base 16 is facing downward as seen in FIG. 2. The lower end of the base 16 is in a horizontal plane. Moving clockwise from this position, the second position is 90 degrees from the first position where the lower end of the base 16 of the tool 14 is in a vertical plane where the lower end of the base 16 is facing left. Continuing clockwise further, the third position is 90 degrees from the second position where the lower end of the base 16 is facing upward and the lower end of the base 16 is in a horizontal plane. The third position is directly opposite the first position. Continuing clockwise even further, the fourth position is 90 degrees from the third position where the lower end of the base 16 is facing right and the lower end of the base 16 is in a vertical plane. The fourth position is directly opposite the second position. The first position, as seen in FIGS. 2-6, is useful for cleaning the top surface of the blades of a ceiling fan 46 (see FIG. 1), the top of furniture, or any other horizontal surface where dust and dirt accumulates. The second and fourth positions allow a user to run the brush 22 along vertical surfaces such as vertically mounted grills, walls, door jams, window jams, vertical surfaces of furniture, or any other vertical surface where dust and dirt may accumulate. The third position is useful for the bottom surface of the blades of a ceiling fan 46, ceiling mounted grills, ceilings, or any other horizontal surface, which may accumulate dust and dirt. In an alternative embodiment the connector on the handle 12 may be provided with four holes 30 and the connector on the tool has at least two balls 32. Only two balls 32 are needed since the connector on the handle 12 has four holes 30. The tool 14 may have more than two balls 32 to provide a more secure attachment of the two members. In this embodiment the release buttons 28 may be replaced with a release slide 38 (see FIG. 6A) where the user draws back on the slide 38 to release the balls 32 from the holes 30 so that the tool 14 may be rotated relative to the handle 12 or to remove the tool 14 from the handle 12. The slide 38 has an inner surface that is tapered (see FIG. 6A). As the slide 38 is moved the tapered surface gradually pushes the locking balls out of the holes. Once the balls 32 have been disengaged from the holes 30 the user may rotate the tool 14 or remove the tool 14 from the handle 12. Once the tool 14 is in the appropriate position the slide is released and the balls will engage the holes 30 to lock the tool 14 in position. The release slide 38 is biased by a spring or the like to return to a position when the balls 32 will engage the holes 30.

The handle 12 and the tool 14 are both provided with ninety-degree tubular bends 20 as seen in FIG. 2. These two tubular bends 20 enable the user to position the brush 22 on upper horizontal surfaces such as fan blades as seen in FIG. 1. The handle 12 and the tool 14 may be made of a durable plastic such as polypropylene, polyethylene, nylon, or a fiber-reinforced plastic. They may also be made of a metal such as steel or aluminum. It is desirable that brush 22 of the tool 14 has a length that is greater than the width of a ceiling fan blade. This enables the user to clean the fan blades with a single pass.

The handle 12 has two tubular extensions 18 joined by a 90 degree tubular bend 20. The handle 12 has a first or vertical tubular extension 18 provides the user with a greater vertical reach. The second or horizontal tubular extension 18 provides the user with a greater horizontal reach. Preferably the length of first tubular extension is greater than the length of the second tubular extension 18. It is also preferable that the length of the both the first and second tubular extensions 18 of the handle 12 is greater than the length of the tubular extension 18 of the tool 14. The lower end of the handle 12 has a locking mechanism for securing the handle 12 to a vacuum cleaner hose 44. The locking mechanism may be a spring-loaded locking button 34 as seen in FIGS. 2 and 8. The locking button 34 on the handle 12 is received into a locking aperture 36 in the hose to securely join the two components together. It has also been contemplated that the handle 12 may be provided with other locking mechanisms such as but not limited to a friction lock or a locking button aperture 36 in the event vacuum cleaner 44 hose has a spring-loaded locking button 34. The friction lock can be where the end of the handle is tapered. The diameter will be smaller at the terminal end of the handle 12 and the diameter will taper to a gradually increasing diameter spaced inward from the terminal end. This increasing taper will provide a tight friction fit between the handle 12 and the vacuum cleaner hose 44. Moreover, it is envisioned that the locking mechanism of the handle 12 will be selected such that it a complementary and capable of mating with the locking mechanism on the vacuum cleaner hose 44 on which it is to be employed. This may be achieved by producing handles 12 to mate with specific vacuum cleaner hoses 44 and their associated locking mechanisms. This may also be achieved by providing one or more adaptors, which make the handle 12 capable of being secured to a variety of vacuum locking mechanisms. The handle 12 may be provided with one or more tubular extenders 42 that allow the user with a greater vertical reach (see FIG. 8B). The extenders 42 would be attachable to the terminal end of the vertical tubular extension 18 of the handle 12 to enable the user to reach higher surfaces without the need for a ladder. The tubular extender 42 may be provided with a spring-loaded locking button 34 and a locking aperture 36 so that they can be secured on the handle 12 and so that the tubular extenders 42 may be linked to further extend the vertical reach of the user.

A wet/dry adaptor 40 may also be supplied so that the handle 12 may be attached to a wet/dry vacuum (see FIG. 8A). A Wet dry vacuum typically has more suction power, a larger diameter hose, and is capable of holding more debris than a household vacuum. It is envisioned that the handle 12 with the wet/dry adaptor 40 will facilitate the cleaning of exterior horizontal and vertical surfaces such as eaves, soffit, fascia, siding, doors, windows, screens, or any other exterior surface on which dirt and dust may collect.

I claim:

1. A wand for attachment to a vacuum cleaner, the wand comprising:

an elongated bent handle having a first end and a second end;

said first end having locking buttons for attachment to a vacuum cleaner hose extending from said vacuum cleaner for obtaining access to suction;

a tool comprising a base having an elongated housing with an elongated opening containing a brush extending along a full length of said housing;

a tubular extension having a proximal end extending from an attachment on a closed side of said housing, said attachment being offset from a center of said base so that said attachment is closer longitudinally to one end of said housing than an opposite end of said housing;

said tubular extension having a right angled bend with a distal portion of said tubular extension being coextensive with and spaced from a central longitudinal axis of said housing, a distal end of said tubular extension extending past an end of said elongated housing;

a tool connector joining the second end of said elongated bent handle and the distal end of said tubular extension; and said tool connector allowing rotation of said tool with respect to said elongated bent handle and said connector having stop four positions in said rotation, as follows:

a) a first position in which said opening into said housing with brush exposed facing downwardly for cleaning top surfaces of ceiling fan blades, furniture and any other horizontal surfaces where dust and dirt accumulates;

b) second and fourth positions which allow a user to run the brush along vertical surfaces such as vertically mounted grills, walls, door jams, window jams, vertical surfaces of furniture or any other surfaces where dust and dirt may accumulate; and c) a third position for reaching bottom surfaces of ceiling fan blades, and other bottom horizontal surfaces where dust and dirt may accumulate.

2. The wand of claim 1, wherein said distal end of said tubular extension has mounted therein spring loaded locking balls corresponding to said four positions, the tool connector having at least two through holes for receiving said spring loaded balls.

3. The wand of claim 2, wherein the plurality of spring-loaded balls is at least four.

4. The wand of claim 3, wherein the four spring loaded balls are equally spaced apart at 90 degrees apart from each other.

5. The wand of claim 4, wherein the tool connector has exactly two holes to accommodate spring loaded balls and has a release mechanism for engaging spring loaded balls to allow said tubular extension of said tool to move from one stop position to another stop position.

6. The wand of claim 5, wherein the handle and the tool are made of a material selected from the group consisting of aluminum, steel, metal, plastic, polyethylene, polypropylene, or fiber reinforced plastic.

7. The wand of claim 6, wherein at least one adaptor is provided to connect the wand to a wet/dry vacuum.

8. The wand of claim 6, wherein a plurality of adaptors is provided where each adaptor is capable of connecting the wand to a different vacuum.

9. The wand of claim 5, wherein a attachment being offset from a center of said base so that said attachment is closer longitudinally to one end of said housing than an opposite end of said housing proximal portion of said tubular extension attached to said housing has a length which is shorter than the length of said distal portion.

* * * * *